US005129919A

United States Patent [19]

Kalinowski et al.

[11] Patent Number: 5,129,919

[45] Date of Patent: * Jul. 14, 1992

[54] BONDED ABRASIVE PRODUCTS CONTAINING SINTERED SOL GEL ALUMINA ABRASIVE FILAMENTS

[75] Inventors: Paul W. Kalinowski, Boylston; Muni S. Ramakrishnan, Northboro; Charles V. Rue, Petersham; David A. Sheldon, Worcester; Brian E. Swanson, Northboro, all of Mass.

[73] Assignee: Norton Company, Worcester, Mass.

[ * ] Notice: The portion of the term of this patent subsequent to Apr. 23, 2008 has been disclaimed.

[21] Appl. No.: 517,916

[22] Filed: May 2, 1990

[51] Int. Cl.[5] ..... B24D 3/02

[52] U.S. Cl. ..... 51/309; 51/307; 51/308

[58] Field of Search ..... 51/307, 308, 309

[56] References Cited

U.S. PATENT DOCUMENTS

| | | | |
|---|---|---|---|
| 3,183,071 | 5/1965 | Rue et al. | 51/298 |
| 3,387,957 | 6/1968 | Howard | 51/298 |
| 3,481,723 | 12/1969 | Kistler et al. | 51/298 |
| 3,808,015 | 4/1974 | Seufert | 106/65 |
| 4,314,827 | 2/1982 | Leitheiser et al. | 51/309 |
| 4,623,364 | 11/1986 | Cottringer et al. | 51/309 |
| 4,744,802 | 5/1988 | Schwabel | 51/309 |
| 4,786,292 | 11/1988 | Janz et al. | 51/309 |
| 4,788,167 | 11/1988 | Mathers et al. | 501/98 |

*Primary Examiner*—William R. Dixon, Jr.
*Assistant Examiner*—Willie J. Thompson
*Attorney, Agent, or Firm*—David Bennett

[57] ABSTRACT

Resinoid and vitrified bonded abrasive products containing filament shaped sintered alumina based abrasive made up predominantly of fine alpha alumina crystals.

31 Claims, No Drawings

BONDED ABRASIVE PRODUCTS CONTAINING SINTERED SOL GEL ALUMINA ABRASIVE FILAMENTS

TECHNICAL FIELD

The invention relates to bonded abrasive products such as grinding wheels and segments, containing abrasive filaments which are composed predominantly of sintered sol gel alpha alumina crystals.

BACKGROUND

Sol gel, and particularly seeded sol gel aluminous abrasives, have demonstrated substantial advantages over other premium abrasives in broad areas of bonded abrasive applications since their introduction some few years ago. Such abrasives are generally made by drying and sintering a hydrated alumina gel which may also contain varying amounts of additives such as MgO or $ZrO_2$. The dried material is crushed either before or after sintering to obtain irregular blocky shaped polycrystalline abrasive grits in a desired size range. The grits may later be incorporated in a bonded abrasive product such as a grinding wheel or a segment.

U.S. Pat. No. 4,314,827 to Leitheiser et al. discloses abrasive grits made by such a method in which the sintered grits contain irregular "snowflake" shaped alpha $Al_2O_3$ crystals which are on the order of 5 to 10 microns in diameter. The spaces between the arms of a "snowflake" and between adjacent "snowflakes" are occupied by other phases such as a finely crystalline alumina magnesia spinel.

U.S. Pat. No. 4,623,364, which issued on Nov. 18, 1986 assigned to Norton Company, the assignee of this application, discloses a sol gel method for the manufacture of aluminous abrasive grits, and products other than abrasive grits such as coatings, thin films, fibers, rods or small shaped parts, having enhanced properties. In that patent the conversion of the hydrated alumina to alpha alumina is facilitated by the introduction of seed material into the gel or the gel precursor prior to drying. This can be accomplished by either wet vibratory milling of the gel or gel precursor with alpha alumina media, or by the direct addition of very fine seed particles in powder or other form. To make abrasive grits the seeded gel is dried, crushed and fired. The abrasive grits so produced may be used in the manufacture of products such as coated abrasive disks and grinding wheels. Alternatively, to make shaped parts or rods, the material may be formed or molded as by extrusion before firing. In the case of extrusion, the rods formed are later cut or broken into appropriate lengths.

Once the gel has formed, it may be shaped, according to the patentee, by any convenient method such as pressing, molding or extrusion and then carefully dried to produce an uncracked body of the desired shape. If abrasive material is desired, the gel can be extruded, according to the disclosure, or simply spread out to any convenient shape and dried. After drying, the solid body or material can be cut or machined to form a desired shape or crushed or broken by suitable means, such as a hammer or ball mill, to form abrasive particles or grains.

Such seeded sol gel abrasives have a much firmer alpha $Al_2O_3$ crystal structure and higher density than the Leitheiser-type unseeded sol gel material. The alpha $Al_2O_3$ crystals of the seeded sol gel abrasives are submicron sized and usually on the order of about 0.4 microns and less, although somewhat coarser structure may result if the seeding is performed in a non-optimal manner or if the firing is at too high a temperature, or for too long a duration.

Other materials such as iron oxide, chromium oxide, gamma alumina, and precursors of these oxides, as well as other fine debris that will act as nucleating sites for the alpha alumina crystals being formed, can also be used as seeds to facilitate the conversion to alpha $Al_2O_3$. As a rule of thumb, such seeding materials should be isostructural with $Al_2O_3$ and should have similar (within about 15%) crystal lattice parameters to work well.

U.S. Pat. Nos. 3,183,071 to Rue et al. and 3,481,723 to Kistler et al. disclose grinding wheels for use in heavy duty snagging operations made with extruded rod shaped polycrystalline alpha alumina abrasive grits. Kistler et al. refers broadly to the use of extruded polycrystalline sintered alumina abrasive rods with diameters of the order of about 26 to 160 mils (0.65 to 3.28 mm) which are formed by extruding a slurry of alpha $Al_2O_3$ or other suitable fine ceramic particles which have been mixed with organic binding agents to facilitate the extrusions.

Similarly, Howard in U.S. Pat. No. 3,387,957 of Jun. 11, 1968 extrudes bauxite as small diameter straight cylindrical rods to lengths longer than the diameter for use as abrasive in resin-bonded snagging wheels.

The rod shaped abrasive grits of the Rue '071, Kistler '723, and Howard '957, are intended for heavy duty snagging operations on steel and the rod shaped abrasive grits are in practice rather coarse, generally a rod diameter equivalent to a size 16 grit or coarser. While it is possible, in theory, to make finer grit having smaller cross sections and diameters, it would be necessary to incorporate excessive amounts of organic binders, extrusion aids, and lubricants in the slurry in order to be able to extrude it through the finer holes. These additives would all have to be burnt out during sintering which would result in either excessive porosity and therefore weakness in the sintered rods or would require excessive firing in order to densify the material after the additives are burned out. The high firing would result in excessive and undesirable grain growth in the product.

SUMMARY OF THE INVENTION

The invention relates to bonded abrasive products which incorporate sintered sol gel alpha alumina based polycrystalline abrasive filaments. The crystallites in the abrasive filaments may be as large as 2 microns but are preferably less than about 1 micron and even more preferably less than about 0.4 micron. The filaments can be made by preparing a sol gel of a hydrated alumina, spinning or extruding the gel into filaments, drying the filaments, and firing the dried filaments to a temperature of not more than about 1500° C. In its preferred mode, the process includes the addition to the initial sol or gel, an effective amount of a submicron crystalline seed material that promotes the rapid conversion of the hydrated alumina in the gel to very fine alpha alumina crystals when the extruded and dried sol gel is fired. Examples of such seed material are beta alumina, gamma alumina, chromium oxide, alpha ferric oxide, alpha alumina and precursors thereof.

The microcrystals are formed by a growth process from a sol-gel and this permits the conversion to alpha alumina at relatively low temperatures that does not lead to excessive crystal growth. This leads to a characteristic fine uniform microstructure, particularly where the sol-gel has been seeded. This growth process is very important and leads to significant differences between seeded sol gel products and products formed by sintering alpha alumina particles. Unless relatively high temperatures are used (which leads to crystal growth), these latter products tend to have weak sinter bonds between adjacent crystallites and thus have to be fired at high temperatures. As a result, they tend to have crystallite sizes that are relatively large.

It is further preferred that the crystal structure be substantially free of impurities that, upon firing, would give rise to glassy material. By "glassy" material is meant amorphous non-crystalline material with no long-term molecular order. Thus the particles of the invention contain less than 5% and preferably less than 2% by weight of any such glassy component.

DETAILED DESCRIPTION OF THE INVENTION

For purposes of this application and the invention disclosed, the terms "abrasive filament(s)" is used to refer to elongated ceramic abrasive bodies each having a generally consistent cross section along its length and wherein the length is at least about equal to and more preferably at least about twice the maximum dimension of the cross section. The maximum cross-sectional dimension should not exceed about 2.0 mm and preferably is less than about 0.5 mm. The abrasive filaments of the invention may be bent or twisted so that the length is measured along the body rather than necessarily in a straight line.

The abrasive filaments are preferably obtained, in general, by extruding or spinning a preferably seeded gel of hydrated alumina into continuous filaments, drying the filaments so obtained, cutting or breaking the filaments to the desired lengths and then firing the filaments to a temperature of not more than 1500° C.

In addition to the hydrated alumina that is used in sol-gel processes to generate alpha alumina, the sol may include up to 10–15% by weight of additives such as spinal, mullite, manganese dioxide, titania, magnesia, ceria, zirconia in the form of a powder or a precursor can also be added in larger amounts, e.g. 40% or more, or other compatible additives or precursors thereof. It should preferably not however incorporate any material that under firing conditions to sinter the alpha alumina, would generate a glassy material. The acceptable additives are those that improve such properties as fracture toughness, hardness, friability, fracture mechanics, or drying behavior. In its most preferred embodiment, the sol or gel includes a dispersed submicron crystalline seed material or a precursor thereof in an amount effective to facilitate the conversion of the hydrated alumina particles to alpha alumina upon sintering. The amount of seed material should not exceed about 10% by weight of the hydrated alumina and there is normally no benefit to amounts in excess of about 5%. Indeed, if too much seed material is used, the stability of the sol or gel could be impaired and the product would be difficult to extrude. Moreover, very large amounts of alpha alumina, say 30% or more by weight, lead to a product that has to be fired at higher temperatures to sinter the crystals into a coherent structure. This leads to either large crystals (if an adequate sintering is achieved) or poor strength (if the temperature is kept low to avoid such crystal growth). If the seed is adequately fine (preferably 60 $m^2$ per gram or more), amounts of from about 0.5 to 10% may be used with 1–5% being preferred.

Examples of solid, microcrystalline seed materials are beta alumina, alpha ferric oxide, alpha alumina, gamma alumina, chromium oxide, and other fine debris that will provide a nucleation site for the alpha alumina crystals being formed, with alpha alumina being preferred. The seeds may also be added in the form of a precursor such as ferric nitrate solution. In general the seed material should be isostructural with alpha alumina and have similar crystal lattice dimensions (within 15%) and be present in the dried gel at the temperatures at which the conversion to alpha alumina takes place (about 1000° to 1100° C.).

The green abrasive filaments may be formed from the gel by a variety of methods, such as by extrusion or spinning. Extrusion is most useful for green filaments between about 0.254 mm and 1.0 mm in diameter which, after drying and firing, are roughly equivalent in diameter to that of the screen openings used for 100 grit to 24 grit abrasive grits, respectively. Spinning is most useful for fired filaments less than about 100 microns in diameter. Fired filaments as fine as 0.1 micron (0.001 mm) have been made by spinning in accordance with the invention. The green filaments shrink about 40% in diameter from their extruded diameter upon firing.

Gels most suitable for extrusion should have a solids content of from about 30% to about 68% and preferably from about 45% to about 64%. The optimum solids content varies directly with the diameter of the filament being extruded, with about 60% solids content being preferred for filaments having a fired diameter roughly equivalent to the screen opening for a 50 grit crushed abrasive grit (about 0.28 mm). As indicated above, attempts to achieve too high a solids content in the gel by incorporating solid materials usually has a severe detrimental effect on the stability of the gel. The extrudate has little green strength as a rule and often will not hold a filamentary shape except at diameters about 2 mm.

Spinning in accordance with the invention may be performed by placing a quantity of the gel on a disk which is then spun to fling green filaments off, which dry almost immediately in the air. Alternatively, the gel may be placed in a centrifuge bowl having holes or slots drilled in its periphery of the size desired for the green filaments and the bowl is spun at, for example, 5,000 rpm to form the filaments. Other known spinning methods may also be used to form the green filaments. For spinning the most useful solids content is between about 20% to 45%, with about 35% to 40% being preferred.

If the filaments are being formed by spinning, it is desirable to add about 1% to 5% of a non-glass-forming spinning aid, such as polyethylene oxide, to the sol from which the gel is formed in order to impart desirable viscoelastic properties to the gel for filament formation. The optimum amount of spinning aid varies inversely with the solids content of the gel. The spinning aid is burnt out of the filaments during calcining or firing. Since very little of it need be added (generally none at all for extrusion), it does not substantially affect the properties of the fired filaments.

Various desired shapes may be imparted to extruded gel filaments by extruding the gel through dies having the shape desired for the cross section of the filament. These can for example be square, diamond, oval, tubular, or star-shaped. Most frequently, however, the cross-section is round. If the gel filaments are relatively large in cross section or have been made from a gel containing a large amount of water, it may be necessary or preferable to dry them at a temperature below 100° C. for 24–72 hours before subjecting them to any heating above 100° C. If the gel filaments have a relatively thin cross section or are made from very high solids gels, drying may not be necessary.

The initially formed continuous filaments are preferably broken or cut into lengths of the maximum dimension desired for the intended grinding application. In general, any shaping or partitioning operation needed to convert the continuous filaments into discrete bodies or to change their shape is best accomplished at the gel stage, or the dried stage because it can be accomplished with much less effort and expense at these points than by attempting to operate on the much harder and stronger bodies formed after final firing according to this invention. Thus, as the continuous filaments emerge from the extruder die, such may be reduced to the desired length filament by any suitable means known to the art, for example, by a rotating wire cutter mounted adjacent the face of the die. Alternatively, the dried filaments may be broken or lightly crushed and then classified to desired ranges of length.

After the gel filaments have been shaped as desired and cut or crushed, and dried if needed, they are converted into final form filaments by controlled firing. The firing should be sufficient to convert substantially all the alumina content of the gel filaments into crystalline alpha alumina, but should not be excessive in either temperature or time, because excessive firing promotes undesirable grain or crystallite growth. Generally, firing at a temperature of between 1200° C. to 1350° C. for between 1 hour and 5 minutes respectively is adequate, although other temperatures and times may be used. In this matter, the sol-gel formed materials are very distinctive in that they can be fired at such comparatively low temperatures and achieve excellent sintering and complete conversion to alpha alumina. By contrast, products with a significant content of alpha alumina before firing need to be heated to much higher temperatures to achieve adequate sintering.

For filaments coarser than about 0.25 mm, it is preferred to prefire the dried material at about 400°–600° C. from about several hours to about 10 minutes respectively, in order to remove the remaining volatiles and bound water which might cause cracking of the filaments during firing. Particularly for filaments formed from seeded gels, excessive firing quickly causes larger grains to absorb most or all of smaller grains around them, thereby decreasing the uniformity of the product on a micro-structural scale.

The abrasive filaments of this invention should, preferably, have an aspect ratio, i.e. the ratio between the length along the principal or longer dimension and the greatest extent of the filament along any dimension perpendicular to the principal dimension, of from about 1.5 to about 25. Where the cross-section is other than round, e.g. polygonal, the longest measurement perpendicular to the lengthwise direction is used in determining the aspect ratio.

Preferably, the aspect ratio ranges from about 2 to about 8, although longer filaments are also useful in many applications. The filaments most useful in the practice of the invention have a hardness of at least 16 GPa and preferably at least 18 GPa for most applications (Vickers indenter, 500 gm load), and are preferably at least 90% and usually most preferably at least 95% of theoretical density. Pure dense alpha alumina has a hardness of about 20–21 GPa. In some instances, at least, the abrasive filaments used in the practice of the invention may have a twist in their lengthwise dimension, or be somewhat curved or bent.

The abrasive filaments of the invention may be curled or twisted or curved. In fact, it is believed that curved or twisted abrasive filaments may be superior to their straight counterparts because the curved or twisted configuration would make abrasive so shaped more difficult to pull out of its bond. In addition, such curled or twisted abrasive filaments make it easier to obtain desired ranges of loose packed density in a grinding wheel. The diameter of the abrasive filaments can be as high as about 2 mm, but it is found that superior performance often results from smaller diameters. Thus, the preferred particles have a cross-section below 1 mm and preferably below about 0.5 mm. The abrasive filaments of the present invention have been found to produce bonded abrasive products that are far superior to the same products containing crushed fused and sintered abrasive grain which have a cross section (grit size) about equal to the diameter of the abrasive filament.

The orientation of the filaments in the abrasive article is not critical and in general there will be no dominant orientation unless special measures are taken. It is believed that greatest efficiency will be achieved by orienting the filaments radially so that one end is presented at the cutting surface.

The invention relates to bonded abrasive products, such as grinding wheels, segments, and sharpening stones, which are comprised of a bond and sintered sol gel abrasive filaments. The amounts of bond and abrasive may vary, on a volume percent basis, from 3% to 76% bond, 24% to 62% abrasive, and 0% to 73% pores. As can be seen from these volume percent compositions, the filament shaped abrasive allows the production of bonded abrasive products with significantly higher structure numbers in softer grades than were heretofore possible with conventionally shaped equiaxed abrasive. However, conventional pore inducing media such as hollow glass beads, solid glass beads, hollow resin beads, solid resin beads, foamed glass particles, bubbled alumina, and the like, may be incorporated in the present wheels thereby providing even more latitude with respect to grade and structure number variations.

The abrasive products may be bonded with either a resinoid or vitrified bond. The preferred resinoid bonds are based on phenol-formaldehyde resin, epoxy resin, polyurethane, polyester, shellac, polyimide, polybenzimidazole or mixtures thereof. The bonds may include from 0% to 75% by volume of any one or several fillers or grinding aids as is well known in the art. When the bond is of the resinoid type, suitable fillers include cryolite, iron sulfide, calcium fluoride, zinc fluoride, ammonium chloride, copolymers of vinyl chloride and vinylidene chloride, polytetrafluoroethylene, potassium fluoroborate, potassium sulfate, zinc chloride, kyanite, mullite, nepheline syenite, molybdenum disulfide, graphite, sodium chloride, or mixtures of these various materials. Vitrified bonds, while amenable to the incorporation of fillers therein, somewhat limit the number of fillers which are useful because of the relatively high temperatures which are required to mature such bonds. However, fillers such as kyanite, mullite, nepheline syenite, graphite, and molybdenum disulfide may be used depending on the maturing temperature of a particular vitrified bond. Vitrified bonded wheels may also be impregnated with a grinding aid such as molten sulfur or may be impregnated with a vehicle, such as epoxy resin, to carry a grinding aid into the pores of the wheel. The properties of bonded abrasive products can be significantly modified by impregnation with a thermosettable resin only such as an epoxy resin, polyester, urethane, phenol-formaldehyde resin, or the like.

In addition to fillers and grinding aids, these bonded sintered filament shaped alumina based abrasive containing products may also include a second abrasive in amounts ranging from about 1% to 90% by volume of the total wheel. The second abrasive may act as a filler as, for example, if the abrasive is fine in grit size, or if the abrasive is coarser it would function as an auxiliary or secondary abrasive. In some grinding applications the second abrasive will function as a diluent for the premium sintered filament shaped alumina based abrasive. In other grinding applications the second abrasive may even enhance the overall grinding properties of the bonded product, either in overall efficiency or in finish imparted to the material being ground. The second abrasive may be a fused alumina, cofused alumina-zirconia, non-filament shaped sintered alumina-zirconia, silicon carbide, cubic boron nitride, diamond, flint, garnet, bubbled alumina, bubbled alumina-zirconia and the like.

The invention filament shaped abrasive and the bonded products containing said abrasive are, in general, superior to prior art abrasives as the following examples show. The abrasive products are suitable for grinding all types of metal such as various steels like stainless steel, cast steel, hardened tool steel, cast irons, for example ductile iron, malleable iron, spheroidal graphite iron, chilled iron and modular iron, as well as metals like chromium, titanium, and aluminum. As is the case with all abrasives and the bonded products containing them, the abrasive and bonded products of the invention will be more effective grinding some metals than others and will be more efficient in some grinding applications than in others. Outstanding portable, cut-off, precision, segment, track grinding, and tool sharpening wheels result when the abrasive utilized therein is the filament shaped abrasive described herein.

EXAMPLES OF THE PREFERRED EMBODIMENTS

Example I

In this example, 196.4 kg Pural ® NG alumina monohydrate powder obtained from Condea Chemie GmbH, 38.2 kg milled water containing 1.37 kg alpha alumina seeds, and 28.8 kg distilled water were mixed in a conventional double shell V-blender for five minutes to form a substantially uniform slurry. At this point, 16 kg of (70% concentration) nitric acid diluted with 44.6 kg of distilled water were added to the mixer while the mixing blades were in motion. After about five minutes of additional mixing, the sol was converted to a gel containing about 61% solids and including substantially uniformly dispersed seeds. The seeds in this example were prepared by milling a charge of distilled water in a model 45 Sweco mill with regular grade 88% alumina grinding media (each 12 mm diameter by 12 mm long) obtained from Diamonite Products Company, Shreve, Ohio, until the particulates (alumina seeds) in the water reached a specific surface area of at least 100 $M^2/g$.

The Pural ® NG powder used had a purity of about 99.6% with minor quantities of carbon, silica, magnesia, and iron oxide.

The seeded gel was conventionally extruded through a smooth walled die with multiple holes about 1.19 mm in diameter to produce continuous gel filaments. The gel filaments were then dried for 24–72 hours at a temperature of 75° to 80° C. and a relative humidity of >85%. After this drying step, the filaments were relatively brittle and could easily be crushed or broken into short lengths. For this example, the filaments were converted into fibrous bodies with an average length of 2 mm to 8 mm. These short filaments were then converted to alpha alumina by heating at a rate of <2° C. per minute to 800° C., at a rate of about 5° C. per minute from 800° C. to 1370° C., held at the latter temperature for 5 minutes, and then allowed to cool. After cooling, the filaments had an average diameter of about 0.58 mm and random lengths from about 1.5 mm to 6 mm and were substantially pure alpha alumina, with an average crystallite size of 0.3 microns (all crystallite sizes herein are measured by the intercept method) and a hardness of about 16 GPa.

These filaments as described last above were just slightly smaller in diameter than a standard 30 grit abrasive grit. These fibrous grits were made by conventional means into vitreous bonded grinding wheels according to the teachings of commonly-owned U.S. Pat. No. 4,543,107 to Rue, incorporated herein by reference. Comparison grinding wheels were made from 30 grit fused 32A (sulfide process) abrasive grits sold by Norton Company, Worcester, Mass. These test grinding wheels were made 7" (178 mm) in diameter, ½" (12.7 mm) thick and with 1¼" (31.75 mm) hole. The total volume percent abrasive in each wheel was held constant at 48% and the volume percent vitreous bond of composition A (see Table I) was held constant at 7.21%.

TABLE I

| Fused Oxide Composition of Bond A | |
|---|---|
| $SiO_2$ | 47.61 |
| $Al_2O_3$ | 16.65 |
| $Fe_2O_3$ | 0.38 |
| $TiO_2$ | 0.35 |
| CaO | 1.58 |
| MgO | 0.10 |
| $Na_2O$ | 9.63 |
| $K_2O$ | 2.86 |
| $Li_2O$ | 1.77 |
| $B_2O_3$ | 19.03 |
| $MnO_2$ | 0.02 |
| $P_2O_5$ | 0.22 |
| | 100.00 |

An example of an alternative vitrified bond which may be used is that disclosed in pending U.S. patent application Ser. No. 07/236,586 filed Aug. 25, 1988 which is assigned to the same assignee as is the present invention. An example of such a bond is designated as 3GF259A, so designated and sold by the O. Hommel Company of Pittsburgh, Pa. This fritted bond is made up of 63% silica, 12% alumina, 1.2% calcium oxide, 6.3% sodium oxide, 7.5% potassium oxide, and 10% boron oxide, all on a weight percent basis. The mix and green wheels are formed in the conventional manner and the latter fired at 900° C. to mature the bond, the firing cycle being a 25° C./hr. rise from room temperature to 900°°C., a soak at 900° C. of 8 hours, and a free rate of cooling down to room temperature.

After mixing the abrasive grits with the glass bond the test wheels were pressed to shape in steel molds to the desired 44.79% porosity. The wheels were then fired to 900° C. in 43 hours, held at this temperature for 16 hours and allowed to cool to room temperature. The fired wheels were trued and faced to ¼" (6.35 mm) width in preparation for a slot grinding test. The invention, filament shaped abrasive wheels were marked SN119 and the comparison conventional fused abrasive wheels were marked 32A30. The material ground was D3 tool steel hardened to Rc60, the length of slot ground was 16.01 inches (40.64 cm). The tests were made using a Brown and Sharpe surface grinder with the wheel speed set at 6000 sfpm (30.48 smps) and table speed set at 50 fpm (0.254 mps). Tests were conducted at three downfeeds: 1, 2, and 3 mils per double pass (0.025 mm, 0.051 mm, and 0.076 mm) all for a total of 60 mils (1.524 mm). Wheel wear, metal removal, and power, was measured at each infeed rate. The term G-ratio, as used in Table II and subsequently, is the number which results from dividing the volumetric metal removed by the volumetric wheelwear for a given grinding run; the higher the quotient the greater is the quality of the wheel.

Test results are shown in Table II.

TABLE II

| Abrasive (type) | Wheel No. | Feed (mils) | G-Ratio (S/W) | Specific Power (Hp/in 3 min) | Specific Power (Joules/mm3) |
|---|---|---|---|---|---|
| Fused (blocky) | 32A30 | 1 | 4.0 | 7.09 | 19.35 |
| | | 2 | 4.25 | 9.02 | 24.62 |
| | | 3 | stalled wheel | | |
| Sintered (extruded filaments) | SN119 | 1 | 30.28 | 5.11 | 13.95 |
| | | 2 | 21.31 | 4.91 | 13.40 |
| | | 3 | 48.16 | 8.94 | 24.41 |

In dry grinding of type D3 steel at a wheel speed of 6000 surface feet per minute, the wheels were made with abrasive grits according to this invention had five to ten times the life and used less power to remove a unit volume of steel than the best conventional fused blocky abrasive grits of similar cross-sectional diameter.

The advantage of the wheels with elongated filament shaped grits made according to this invention was particularly marked at high metal removal rates. For a given grinding grade, the filament shaped abrasive containing wheels were much freer cutting as the lower power levels in Table II indicate and generated less heat, which in turn produces a burn free finish on the work piece. Low heat and lack of burn are necessary to avoid metallurgical damage to the cutting tool being fabricated.

Example II

In this example, vitrified bonded segments were made with the same grains as described in Example I. These segments were made to fit a 12" (30.48 cm) diameter CORTLAND chuck. Each segment was 5" (12.7 cm) in height and had a cross-section equal to the chordal section of a 12" (30.48 cm) circle where the chord length is 7.5" (19.05 cm). The segments were made in the same manner as the wheels of Example I. A grinding test comparing the invention abrasive to the currently used best fused abrasive was made on 12" (30.48 cm) square steel plates of 1018 steel utilizing a BLANCHARD vertical spindle surface grinder. Grinding was done wet with a 1:40 ratio of water-soluble oil to water.

Three downfeed rates were tested: 0.016"/min (0.406 mm/min), 0.022"/min (0.559 mm/min), and 0.028"/min (0.711 mm/min) and in each case, four runs were made each of 100 mils (2.54 mm) total downfeed. Wheel wear, metal removal, and power were measured for each run. The total results are given in Table III.

TABLE III

| Abrasive (type) | Segment No. | Feed Rate (mils/min) | Feed Rate (mm/min) | G Ratio (S/W) | Power (Kw) |
|---|---|---|---|---|---|
| Fused (blocky) | 32A30s | 16 | 0.406 | 7.44 | 8.4 |
| | | 22 | 0.559 | 5.75 | 12.0 |
| | | 28 | 0.711 | 4.48 | 12.0 |
| Sintered (extruded filaments) | SN119s | 16 | 0.406 | 34.32 | 8.8 |
| | | 22 | 0.559 | 12.64 | 9.2 |
| | | 28 | 0.711 | 12.64 | 9.6 |

As can be seen from the results shown in Table III, the segments made from the invention filament shaped abrasive outperformed the best fused abrasive now in use by 300 to 500% in G ratio while drawing significantly less power at the higher infeed rates.

Example III

In this example, a batch of smaller diameter filament shaped abrasive was made by mixing 3.2 kg Pural® NG alumina monohydrate, with 1.3 kg of milled water containing 22 g of alpha alumina seeds as in Example I. After 5 minutes of mixing, 200 g of 70% nitric acid diluted with 750 cc distilled water was added and mixing continued for an additional five minutes to form a 59% solids gel in which the seeds were uniformly dispersed. The seeded gel was then conventionally extruded through a multiple opening smooth walled die whose openings were 0.60 mm in diameter. After drying, the extruded strands were broken to lengths averaging 3 mm then fired to 1320° C. for five minutes. After firing the individual filaments cross-sectional size is equivalent to a standard 50 grit abrasive. The firing temperature of 1320° C. for 5 minutes was slightly less than that of Example I and the crystallites of the abrasives were sub-micronic in size. Also, as in Example I, the filaments were bent and twisted. These filaments were made into test wheels following the procedure of Example I except that the wheel diameter was 5" (127 mm) and comparison wheels were made with a seeded sol gel alumina abrasive of the same composition as the filament shaped abrasive but produced by breaking up dry cakes to form blocky shaped grain similar to the shape of fused alumina grain. The invention filament shaped abrasive containing wheels were marked X31-1 and the blocky sol gel grain wheels marked SN5. These wheels were tested by slot-grinding hardened D3 steel as in Example I. The results are shown in Table IV.

TABLE IV

| Abrasive (type) | Wheel No. | Dry Slot Grinding Results on D3 Steel: Feed (mils) | G Ratio (S/W) | Specific Power (Hp/in 3 min) | Specific Power (Joules/mm3) |
|---|---|---|---|---|---|
| Sol Gel (blocky) | SN5 | 0.5 | 24.3 | 23.0 | 62.8 |
| | | 1.0 | 35.8 | 15.5 | 42.3 |
| | | 2.0 | 28.8 | 10.6 | 28.9 |
| Sol Gel (extruded, filaments) | X31-1 | 0.5 | 26.27 | 18.2 | 49.7 |
| | | 1.0 | 48.58 | 12.9 | 35.2 |
| | | 2.0 | 73.78 | 8.7 | 23.75 |

These results clearly show the advantage of the filament shaped sol gel alumina abrasive over the sol gel alumina abrasive with blocky shape grains. At the highest infeed rate, the invention grains had 255% higher G ratio and drew 18% less power.

Example IV

Four sets of standard type hot pressed phenol-formaldehyde resin bonded portable grinding wheels were made in the conventional mode and measured 6 inches (15.24 cm) in diameter, 0.625 inches (1.59 cm) in thickness, and had a 0.625 inch (1.59 cm) hole. One set of wheels contained the cofused alumina-zirconia blocky shaped abrasive (AZ) of U.S. Pat. No. 3,891,408; a second set of wheels contained the blocky shaped seeded sol gel alumina abrasive (SGB) of U.S. Pat. No. 4,623,364 in 16 grit (U.S. Standard Sieve Series); and a third set of wheels contained the filament shaped seeded sol gel alumina abrasive (SGF) described above in Example I having a diameter of 0.074 inches (1.5 mm). All of the wheels were essentially the same except for the abrasive type; they were a relatively hard grade having a volume structure composition of 48% abrasive, 48% bond and 4% pores. All the wheels were used in a grinding process which simulated conditions used to grind railroad tracks. The results were as follows, using the wheels containing the well known cofused alumina-zirconia (AZ) abrasive as the reference.

TABLE V

| Abrasive Variation | Constant Power | Rail Grinding Test Relative Results - %: Wheel Wear Rate | Material Removal Rate | KW | G Ratio |
|---|---|---|---|---|---|
| AZ | 1.7 KW | 100.0 | 100.0 | 100.0 | 100.0 |
| SGB | | 239.9 | 116.8 | 106.7 | 48.6 |
| SGF | | 140.2 | 141.6 | 107.8 | 101.0 |
| AZ | 2.2 KW | 100.0 | 100.0 | 100.0 | 100.0 |
| SGB | | 286.4 | 117.7 | 101.2 | 41.1 |
| SGF | | 149.1 | 137.2 | 103.8 | 92.0 |
| AZ | 2.3 KW | 100.0 | 100.0 | 100.0 | 100.0 |
| SGB | | 152.7 | 99.0 | 101.4 | 64.8 |
| SGF | | 140.0 | 128.2 | 99.6 | 91.5 |
| AZ | 2.5 KW | 100.0 | 100.0 | 100.0 | 100.0 |
| SGB | | 248.3 | 107.5 | 103.1 | 43.3 |
| SGF | | 117.5 | 120.9 | 103.5 | 102.9 |

As can be seen from the G-Ratios i.e. the volumetric material removal rate per unit of wheelwear, the overall quality of the currently used AZ abrasive was much superior to the blocky shaped seeded sol gel abrasive, and the filament shaped seeded sol gel abrasive described herein is only equivalent to the AZ. However, in rail grinding it is critical that the railroad tracks are out of service for as short a time as possible due to the necessity of reconditioning the tracks by grinding. Thus the rate at which a grinding wheel removes metal becomes the governing factor in evaluating the quality of a rail grinding wheel. The metal removal rate of the wheels containing the filament shaped seeded sol gel abrasive was vastly superior to that of both the AZ abrasive and the blocky shaped seeded sol gel abrasive. In the several grinding runs the filament shaped abrasive was about 42%, 37%, 28% and 21% superior to AZ in metal removal weight, and about 25, 20, 29, and 13 percentage points better than the blocky shaped seeded sol gel abrasive containing wheels. Why the filament shaped seeded sol gel abrasive is even superior to its blocky shaped counterpart is not fully understood but the difference was pronounced.

Example V

A series of commercial type phenol-formaldehyde resin bonded cut-off wheels were manufactured according to well known methods. The wheels measured 20×0.130×1 inch (50.8×0.33×2.54 cm) and were side reinforced with glass cloth disc having a radius about ½ the radius of the wheel, i.e. the reinforcing cloths had a diameter of about 10 inches. A third of the wheels were made with a 24 grit (based on U.S. Standard Sieve Series) blocky shaped fused crushed alumina sold by Norton Company and known as 57 ALUNDUM (57A), ALUNDUM being a registered trade mark of the Norton Company. A third of the wheels contained the blocky shaped 24 grit seeded sol gel abrasive described by the Cottringer et al. U.S. Pat. No. 4,623,364 (SGB) mentioned above. The last one third of the number of wheels contained the filament shaped seeded sol gel alumina abrasive of the instant invention (SGF) having a cross section about equal to the diameter of the 24 grit equiaxed 57A and blocky seeded sol gel abrasive, i.e. about 0.74 mm. On a volume basis, all of the wheels contained 48% abrasive, 46% bond, and 6% pores.

The wheels were tested dry cutting 1.5 inch (3.81 cm) thick C 1018 steel and 1.5 inch (3.81 cm) thick 304 stainless steel. The wheels were tested on a stone M150 cut-off machine and were run at 12,000 surface feet per minute with 30 cuts made at both 2.5 and 4 seconds per cut with each wheel on the C1018 steel and on the 304 stainless steel bars. The comparative test results cutting C1018 steel and 304 stainless steel are shown in Tables VI and VII respectively.

TABLE VI

| Wheel No. | Abrasive Type | Material Cut - C1018 Steel: Time Cut Sec | MR In3/Min | WW In3/Min | G Ratio | KW | Relative G-Ratio % |
|---|---|---|---|---|---|---|---|
| 1 | 57A | 2.5 | 5.47 | 0.82 | 6.67 | 14.26 | 100 |
| 2 | " | 2.5 | 5.43 | 0.81 | 6.67 | 13.97 | 100 |
| 3 | " | 4.0 | 3.45 | 0.75 | 4.58 | 9.27 | 100 |
| 4 | SGB | 2.5 | 5.47 | 0.51 | 10.79 | 12.67 | 161.8 |
| 5 | " | 2.5 | 5.51 | 0.51 | 10.79 | 13.20 | 161.8 |
| 6 | " | 4.0 | 3.42 | 0.40 | 8.65 | 8.79 | 180.9 |
| 7 | SGF | 2.5 | 5.51 | 0.32 | 17.24 | 11.90 | 258.5 |
| 8 | " | 2.5 | 5.39 | 0.25 | 21.54 | 11.95 | 323.4 |
| 9 | " | 4.0 | 3.37 | 0.16 | 21.54 | 8.04 | 470.3 |

Cutting C1018 steel, the wheels containing the filament shaped seeded sol gel alumina abrasive (SGF) were profoundly superior in overall quality, G-Ratio, to the wheels containing the fused alumina 57A abrasive and to the wheels containing the blocky shaped abrasive SGB counterpart of the SGF material. When the cutting time was 2.5 seconds the SGF wheels had G-Ratios 158.5 and 370.3 percentage points higher than the corresponding 57A wheels, and 380.3 percentage points higher when the cutting time was 4 seconds. The advantage of the SGF over the SGB, though not as great as that over the 57A, it was still very large viz. 96.7 and 161.6 percentage points when the cutting time was 2.5 seconds, and 281.4 percentage points when the cutting time was 4 seconds. It should also be noted that in addition to much higher grinding quality (G-Ratio) the SGF wheels drew significantly less power, in terms of kilowatts (KW) than did either the 57A or SGB abrasives. The power total for all three SGF wheels tested was 31.89 kilowatts, for the three SGB wheels 34.66, and for the three 57A wheels 37.55. The SGF abrasive resulted in power savings of 15.1% as compared to the 57A containing wheels, and a 7.9% savings over wheels containing the SGB abrasive.

TABLE VII

| Wheel No. | Abrasive Type | Material Cut - 304 Stainless Steel: Time Cut Sec | MR In3/Min | WW In3/Min | G Ratio | KW | Relative G-Ratio % |
|---|---|---|---|---|---|---|---|
| 10 | 57A | 2.5 | 5.51 | 1.08 | 5.11 | 12.96 | 100 |
| 11 | " | 2.5 | 5.39 | 0.92 | 5.85 | 12.06 | 100 |
| 12 | " | 4.0 | 3.45 | 0.48 | 7.22 | 8.94 | 100 |
| 13 | " | 4.0 | 3.42 | 0.39 | 8.66 | 9.12 | 100 |
| 14 | SGB | 2.5 | 5.64 | 0.52 | 10.79 | 12.43 | 211.2 |
| 15 | " | 2.5 | 5.51 | 0.51 | 10.85 | 12.34 | 185.5 |
| 16 | " | 4.0 | 3.50 | 0.20 | 17.24 | 9.09 | 238.9 |
| 17 | " | 4.0 | 3.45 | 0.20 | 17.24 | 8.61 | 200.5 |
| 18 | SGF | 2.5 | 5.34 | 0.37 | 14.43 | 11.81 | 282.4 |
| 19 | " | 2.5 | 5.30 | 0.37 | 14.43 | 12.48 | 246.7 |
| 20 | " | 4.0 | 3.39 | 0.16 | 21.54 | 8.82 | 298.3 |
| 21 | " | 4.0 | 3.31 | 0.15 | 21.54 | 8.43 | 248.7 |

As with cutting C1018 steel, the SGF containing wheels vastly outperformed wheels containing the normally used 57A fused crushed alumina abrasive and were significantly better than the SGB abrasive containing wheels. At 2.5 seconds per cut the SGF wheels had G-Ratios of 182.4 and 46.7 percentage points higher than the 57A wheels, and at 4 seconds per cut those same differences were 198.3 and 148.7 percentage points in favor of the SGF wheels. As compared to the SGB containing wheels, the SGF wheels quality advantages of 71.2 and 61.2 percentage points when the time per cut was 2.5 seconds, and 59.4 and 48.2 percentage points when the time per cut was extended to 4 seconds. With respect to power consumption, the SGF containing wheels did, for the most part, result in a power savings as compared to the 57A and SGB wheels but the savings was relatively small.

Example VI

Four sets of commercial type phenol-formaldehyde resin bonded cut-off wheels measuring 20×0.130×1 inch (50.8×0.22×2.5 cm) and side reinforced with glass cloth discs having a radius ½ the radius of the wheel, were manufactured in the conventional manner. The wheels had a volume percent composition of 50% abrasive, 32% bond, and 18% pores. The first set of wheels, a fused crushed blocky shaped alumina abrasive known as 53 ALUNDUM (53A), ALUNDUM being a registered trademark of the Norton Company of Worcester, Mass., the abrasive was 50 grit, based on U.S. Standard Sieve Series. The second set of wheels contained the blocky shaped sintered seeded sol gel abrasive (SGB) of the Cottringer et al. U.S. Pat. No. 4,623,364 which was also 50 grit. The third and fourth sets of wheels contained the filament shaped sintered seeded sol gel abrasive described above in Example I but having a cross section about equal to the diameter of the 50 grit equiaxed 53A and blocky shaped seeded sol gel abrasive. The abrasive in both of these latter sets of wheels had a diameter of about 0.011 inch (0.28 mm) but wheels 26 and 27 had an average aspect ratio of 9 while wheels 28 and 29 had an average aspect ratio of 6; these wheels are identified as SGF(a) and SGF(b), respectively, in Table VIII below.

An oscillating Campbell #406 cutting machine was used to cut 4 inch (10.16 cm) diameter 4340 steel rolls. The cutting was done while flooding the cutting area with water, using an oscillation of a 1.62 inch (4.12 cm) travel at 57 cycles per minute, and times of cut of 1 and 2 minutes. The cutting was done at a wheel speed of 9870 surface feet per minute. The results were as follows:

TABLE VIII

| Wheel No. | Abrasive Type | Material Cut - 4340 Stainless Steel: Time/Cut Sec | Avg. Relative G-Ratio | Avg. Relative Power |
|---|---|---|---|---|
| 22 | 53A | 60 | 100 | 100 |
| 24 | SGB | 60 | 113 | 97 |
| | | 60 | | |
| 26 | SGF(a) | 60 | 319 | 101 |
| | | 60 | | |
| 28 | SGF(a) | 60 | 335 | 102 |
| | | 60 | | |
| 23 | 53A | 120 | 100 | 100 |
| 25 | SGB | 120 | 99 | 84 |
| 27 | SGF(a) | 120 | 350 | 103 |
| | | 120 | | |
| 29 | SGF(b) | 120 | 401 | 102 |
| | | 120 | | |

G-Ratio = volumetric ratio of material removed to wheelwear.

At a time per cut of 60 seconds both filament shaped sintered seeded sol gel abrasives SGF(a) and SGF(b) containing wheels outperformed the widely used fused crushed 53A alumina abrasive and the blocky shaped sister seeded sol gel abrasive SG. The SGB abrasive containing wheel did show a G-ratio 13 percentage points higher than the 53A wheel but the SGF(a) and SGF(b) wheels were respectively 219 and 235 percentage points superior to the standard 53A wheels. When the time to cut through the 4 inch (10.2 cm) diameter was slowed to 120 seconds the 53A and SGB were about the same in quality but the two wheels containing the filament shaped sintered seeded sol gel alumina abrasives, SGF(a) and SGF(b), were 3.5 and 4 times higher in quality than the 53A and SGB wheels. There was no substantial difference in power consumption between the two SGF abrasives of the invention, and the SGB and 53A abrasives. However, even a 25–30% lower power consumption on the part of the SGB and 53A abrasives containing wheels would pale in significance in light of the 219 to 301 percentage point advantage of the filament shaped sintered seeded sol gel abrasives.

Example VII

This example illustrates the effect of crystal size in the grinding performance of abrasives according to the invention.

The abrasive grains were made by a seeded sol-gel process except for one ("G", where the larger crystal size was most readily attained by omission of seeding).

The characteristics of the abrasive grain were as follows:

TABLE IX

| GRAIN # | WATER DENSITY (gm/cc) | CRYSTAL SIZE (MICRON) | SAND BLAST PENETRATION (MM) |
|---|---|---|---|
| A | 3.94 | 1.16 | 3.91 |
| B | 3.93 | 0.65 | 3.84 |
| C | 3.89 | 0.54 | 3.83 |
| D | 3.92 | 0.42 | 4.14 |
| E | 3.90 | 0.39 | 4.16 |
| F | 3.88 | 0.26 | 3.92 |
| G | 3.95 | 2.54 | 2.99 |

The diameter of the particles, which had a circular cross-section, corresponded to a 50 grit size. There was a range of aspect ratios in the samples used to make up a grinding wheel 127 mm×12.7 mm×31.75 mm using the same vitreous bonding material to produce the wheels. Each wheel was dressed to a square wheel face 6.4 mm in width and subjected to "dry" or "wet" grinding modes.

The "dry" grinding mode employed a D-3 steel plate approximately 100 mm×400 mm, Rc60. The wheel speed was 6500 SFPM.

The "Wet" mode employed a 4340 hardened 100 mm×400 mm, a White and Bagley E55 coolant in 1:40 proportions with city water, applied with a 25 mm ID flexible nozzle. The wheel speed was 8500 SFPM.

The procedure used the following parameters:

1. Table Speed of 15.24 m/min.
2. Downfeeds of 0.5, 1.0 and 1.5 in dry mode; and 0.5, 1.0 in wet mode. Total Downfeeds of 100 mils.
3. Measure wheel wear (ww), metal removal rate (mrr), finish, power and force after 100 mils, (except after 100.5 mils with 1.5 mil downfeed in dry mode).
4. Draw wheels with single point diamond at 1 mil downfeed, 250 mm/min crossfeed.

The data obtained is set forth in Tables X and XI below:

The comparative data relate to a commercial conventional sol-gel material with 54 grit size bonded in the same material.

TABLE X

| | | DRY GRINDING | | | | |
|---|---|---|---|---|---|---|
| Identif. | Downspeed (MILS) | Average Peak Power (watts) | $in^3/in.$ MRR | $in^3/in.$ WW | G-Ratio | Surface Finish |
| Comparative: | 0.5 | 940 | 0.2470 | 0.0051 | 58.1 | 60 |
| | 1.0 | 960 | 0.5942 | 0.0096 | 62.0 | 80 |
| | 1.5 | 1120 | 0.8839 | 0.0178 | 49.8 | 100 |
| G | 0.5 | 400 | 0.1035 | 0.1652 | 0.6 | 240 |
| | 1.0 | 500 | 0.1939 | 0.3127 | 0.6 | 320 |
| | 1.5 | 640 | 0.2910 | 0.4852 | 0.6 | 300 |
| A | 0.5 | 720 | 0.2364 | 0.0430 | 5.5 | 170 |
| | 1.0 | 850 | 0.0992 | 0.0690 | 7.1 | 200 |
| | 1.5 | 1000 | 0.7182 | 0.0892 | 8.1 | 280 |
| B | 0.5 | 800 | 0.2631 | 0.0301 | 9.7 | 120 |
| | 1.0 | 1000 | 0.5196 | 0.0514 | 10.1 | 120 |
| | 1.5 | 1120 | 0.7916 | 0.0515 | 15.4 | 260 |
| C | 0.5 | 640 | 0.2625 | 0.0238 | 11.0 | 110 |
| | 1.0 | 960 | 0.5532 | 0.0312 | 17.7 | 150 |
| | 1.5 | 1040 | 0.8239 | 0.0458 | 18.0 | 170 |
| D | 0.5 | 640 | 0.2736 | 0.0262 | 10.5 | 190 |
| | 1.0 | 920 | 0.5650 | 0.0321 | 17.6 | 180 |
| | 1.5 | 1120 | 0.8543 | 0.0317 | 26.9 | 200 |
| E | 0.5 | 480 | 0.2613 | 0.0247 | 10.6 | 190 |
| | 1.0 | 690 | 0.5550 | 0.0333 | 16.7 | 180 |
| | 1.5 | 920 | 0.8284 | 0.0471 | 17.6 | 200 |
| F | 0.5 | 680 | 0.2915 | 0.0079 | 37.1 | 170 |
| | 1.0 | 880 | 0.5838 | 0.0156 | 37.3 | 200 |
| | 1.5 | 1040 | 0.8796 | 0.0176 | 44.8 | 200 |

TABLE XI

| | | WET GRINDING | | | | |
|---|---|---|---|---|---|---|
| Identif. | Downspeed (MILS) | Average Peak Power (watts) | $in^3/in.$ MRR | $in^3/in.$ WW | G-Ratio | Surface Finish |
| Comparative: | 0.5 | 1560 | 0.2470 | 0.0051 | 58.1 | 60 |
| | 1.0 | 1760 | 0.5942 | 0.0096 | 62.0 | 80 |

TABLE XI-continued

| Identif. | Downspeed (MILS) | WET GRINDING Average Peak Power (watts) | in³/in. MRR | WW | G-Ratio | Surface Finish |
|---|---|---|---|---|---|---|
| G | 0.5 | 960 | 0.0741 | 0.2006 | 0.4 | 230 |
| | 1.0 | 960 | 0.1416 | 0.3962 | 0.4 | 200 |
| A | 0.5 | 880 | 0.1422 | 0.1193 | 1.2 | 120 |
| | 1.0 | 1040 | 0.3060 | 0.1958 | 1.6 | 120 |
| B | 0.5 | 960 | 0.2016 | 0.0453 | 4.8 | 180 |
| | 1.0 | 1120 | 0.4236 | 0.0760 | 5.6 | 110 |
| C | 0.5 | 1200 | 0.2439 | 0.0191 | 12.7 | 140 |
| | 1.0 | 1360 | 0.4524 | 0.0661 | 6.8 | 110 |
| D | 0.5 | 1440 | 0.2885 | 0.0100 | 29.0 | 120 |
| | 1.0 | 1520 | 0.5202 | 0.0169 | 30.7 | 200 |
| E | 0.5 | 1440 | 0.2883 | 0.0092 | 31.2 | 100 |
| | 1.0 | 1760 | 0.5658 | 0.0198 | 28.6 | 130 |
| F | 0.5 | 1360 | 0.2961 | 0.0043 | 69.0 | 120 |
| | 1.0 | 1480 | 0.5892 | 0.0105 | 59.1 | 120 |

From the above data it can clearly be seen that the grinding performance improves significantly as the crystallite size decreases. In addition, in the dry grinding, the harder the force applied (increased downfeed), the better the wheel ground. This is most unexpected. The general experience is that G-ratio diminishes with the applied force as the grains begin to polish and become less effective cutting edges. By contrast, the abrasive particles of the invention for the most part just kept on getting better with little extra wheel wear.

Example VIII

This example illustrates the utility of a star-shaped cross-section filamentary abrasive particle.

Particles with a star-shaped cross-section and a crystallite size of about 0.2 micron were made up into a wheel and tested following the procedures set forth in Example IX except that in "dry grinding" an additional downfeed rate of 2.0 mil was added to place the grain under even more pressure. The results are set forth in Table XII:

TABLE XII

| Identif. | Downspeed (MILS) | Power (HP.in) | in³/in. MRR | WW | G-Ratio |
|---|---|---|---|---|---|
| DRY | 0.5 | 4.09 | 0.294 | 0.007297 | 40.3 |
| | 1.0 | 5.65 | 0.589 | 0.010142 | 58.0 |
| | 1.5 | 7.74 | 0.879 | 0.015031 | 58.5 |
| | 2.0 | 7.64 | 1.165 | 0.022874 | 51.0 |
| WET | 0.5 | 6.20 | 0.294 | 0.004233 | 79.5 |
| | 1.0 | 8.36 | 0.592 | 0.008401 | 70.4 |

As will be appreciated, the star-shaped particle was particularly effective.

Example IX

This Example illustrates the surprising finding that with the abrasive particles of the invention, the trend to smaller cross-section leads to an improvement in G-Ratio. This is not the experience with decreasing seeded sol-gel grain grit size. This is a particularly surprising result since the grains are chemically identical, differing only in the physical shape of the grit.

M7 (Rc62) steel was wet ground internally using 5% Trim VHPE300 as coolant. The wheels used were approx. 76 mm×12.6 mm×24 mm and the grains were held in a vitreous bond system.

The wheel speed was 11,000 rpm and the work speed was 78 rpm. Trueing was done with a single point diamond using a 0.005 inch/revolution lead and a 0.001 inch diameter depth of dress.

The wheels tested were as follows:

SG-80 and SG-150,

Inv.-80 and Inv.-150, where SG indicates a commercial seeded sol-gel alumina grain of a blocky shape produced by crushing and grading layer crystals. The associated number is the grit size. Inv. indicates a grain according to the invention with the associated number indicating the grit size corresponding to the diameter of the cylindrical grains. In each case, the crystallite size was about 0.2 micron.

The G-Ratios obtained with all wheels were measured and compared. The results are given in Table XIII:

TABLE XIII

| G-RATIO (3 GRINDS) | | | |
|---|---|---|---|
| SG-80 | 12.4, | 11.6, | 11.8 |
| SG-150 | 10.4, | 8.5, | 7.0 |
| INV.-100 | 8.0, | 9.2, | 9.6 |
| INV.-150 | 10.4, | 11.4, | 13.0 |

Thus, with SG grain decreasing, grit size leads to the expected drop in G-Ratio and, in addition, the successive grinds showed a slowly falling G-Ratio. all this is in accordance with the trends expected for such grains.

However, decreasing the diameter of the grains according to the invention actually increased the G-Ratio and the successive grinds showed that the wheel was actually cutting better with use. It is noted in passing that the surface finish did not change much from a generally good level.

These improvements are unpredictable based on the known SG grains and lead to a preference, in the abrasive articles of the invention, for the largest cross-sectional diameter to be less than 1 mm and more preferably less than 0.5 mm.

Example X

This Example compares the performance of grinding wheels of the invention with wheels made using seeded sol-gel grains. In each case, the crystallite size in the grains was less than about 0.2 micron.

The test involved plunge slot grinding using a Brown & Sharpe machine with a wheel speed of 5000/6525 rpm corresponding to a linear speed of 6500/8500 sfpm. The table traverse was at 50 fpm.

Dry grinding was performed on D3 steel with a hardness of 59 Rc.

Wet grinding was performed on 4340 steel. In each case, the plate was 16"×4".

The grits were held in the same standard commercial vitreous bond formulation. The wheels were trued using a single point diamond with a 1 mil. infeed and a 10 inch/minute cross-feed rate.

Wet grinding used a 2.5% White and Bagley E-55 solution as coolant.

The results obtained are shown on Table XIV.

TABLE XIV

| GRIT | DOWN-FEED MILS | MRR | AVG. G-RATIO | CUMULATIVE AVG. G-RATIO |
|---|---|---|---|---|
| Dry: | | | | |
| SG-54 | 0.5 | 0.291 | 42.0 | 44.7 |
| | 1.0 | 0.570 | 34.3 | 33.4 |
| | 2.0 | 1.125 | 22.3 | 25.4 |
| INV-50 | 0.5 | 0.288 | 36.1 | 38.2 |
| | 1.0 | 0.574 | 43.9 | 45.4 |
| | 2.0 | 1.558 | 50.0 | 54.8 |
| Wet: | | | | |
| SG-54 | 0.5 | 0.290 | 127.7 | 93.6 |
| | 1.0 | 0.590 | 67.0 | 65.1 |
| INV-50 | 0.5 | 0.288 | 171.2 | 133.4 |
| | 1.0 | 0.587 | 87.8 | 81.0 |

SG-54 indicates a seeded sol-gel with a grit size of 54.
INV-50 indicates an abrasive particle according to the invention with a round cross-section and a diameter corresponding to a grit size of 50.

From the above it can be seen that dry grinding shows the grits of the invention to be unusual in that they continue to grind better as they go along and, although in wet grinding the performance falls with time, it is still far superior to the closely similar commercial seeded sol-gel product.

Example XI

This example illustrates the difference in strength between seeded sol-gel filaments which are the preferred filamentary abrasive particles for use in the bonded products of the invention and filamentary abrasives made by extruding and sintering a composition comprising a significant amount of pre-existing alpha alumina particles.

A seeded sol gel product was produced by mixing boehmite (Condea's "Disperal"), with water and 1% by weight of the boehmite of submicron sized alpha alumina in a V-blender for two minutes. An 18 weight percent solution of nitric acid was then added to give 7.2% by weight of nitric acid based on the weight of the boehmite. The mixing was continued for a further five (5) minutes to produce a boehmite gel.

A series of products was then prepared for comparative purposes that corresponded to the above except that more alpha alumina (of the kind used as seed material above), was added such that total mixture had much higher proportions by weight of alumina. The boehmite was retained to give the mixture extrudability. The formulations are described in Table XII below.

TABLE XV

| Batch | Variation | % Solids |
|---|---|---|
| Comparative A | 30% alpha alumina/70% gels | |
| Comparative B* | 30% alpha alumina/70% gels | |
| Comparative D | 90% alpha alumina/10% gel | |
| Comparative E | 60% alpha alumina/40% gel | |
| Comparative F | 60% alpha alumina/40% gel | |
| Example 1 | 1% alpha alumina (seed) | |
| Example 2 | 1% alpha alumina (seed) | 58% |

TABLE XV-continued

| Batch | Variation | % Solids |
|---|---|---|
| Example 3 | 1% alpha alumina (seed) | |

*Additional ultrasonic mixing of slurry was used.

These materials were then extruded to form filaments that were dried and sintered under the conditions described below. Higher temperatures were required to sinter the high alpha alumina comparative batches than those produced by the seeded sol gel process. Samples of the filaments were then tested for their strength according to a simple three point process using an Instron test machine with a cross head speed of 0.2 cm/min. The filament was supported on a pair of edges spaced 1 cm apart (0.9 cm in the case of Comparatives C, D, and E). A downward pressure was applied midway between these points by a knife edge. The pressure was gradually increased until the filament broke and that pressure, divided by the cross-sectional area of the filaments, is reported in Table XIII below as the breaking strength.

TABLE XVI

| Batch | Temp/Time Firing | | Filament Diameter (mm) | Breaking Strength kg/cm² Average | Breaking Strength kg/cm² High |
|---|---|---|---|---|---|
| Comp. A | 1500° C. | 30 min. | 0.32 | 6,831 | 7,465 |
| Comp. B | 1550° C. | 30 min. | 0.3175 | 6,162 | 6,268 |
| Comp. C | 1450° C. | 60 min. | 1.00 | 5,424 | 6,646 |
| Comp. D | 1300° C. | 6 min. | .88 | 3,430 | 4,036 |
| Comp. E | 1350° C. | 6 min. | .87 | 2,378 | 2,436 |
| Ex. 1 | 1370° C. | 4 min. | 0.054 | 11,197 | 13,239 |
| Ex. 2 | 1350° C. | 30 min. | 0.043 | 14,366 | 15,986 |
| | 1350° C. | 5 min. | 0.046 | 14,154 | 17,112 |
| | 1325° C. | 30 min. | 0.046 | 14,296 | 16,549 |
| | 1350° C. | 30 min. | 0.053 | 10,281 | 14,859 |
| Ex. 3 | 1350° C. | 30 min. | 0.020 | 16,000 | 18,169 |

The filaments of the Comparative batches were much thicker because it was very difficult to extrude finer filaments with dimensional integrity after extrusion and before firing. Higher proportions of alpha alumina were found to exacerbate this problem significantly.

As can be seen from a comparison of the above data, the comparative filaments had significantly lower breaking strengths and this is believed to reflect the weaker sinter bonds developed between the alpha alumina crystals as a result of the sintering process. Therefore, the preferred seeded sol gel filaments have a breaking strength of at least 8,000 and more preferably at least 10,000 kg per square centimeter of cross-section when measured by the test described above. This is in contrast to products made by sintering pre-formed alpha alumina where much lower strengths are obtained.

What is claimed is:

1. A bonded abrasive product comprised of a sintered sol gel alumina based filament shaped abrasive and a bond therefor wherein said filament shaped abrasive has a substantially uniform cross-section, an average aspect ratio of greater than about 1.0, a hardness of at least 16 GPa, and is comprised predominantly of alpha alumina crystals having a size of less than about 2 microns.

2. The bonded abrasive product of claim 1 wherein said sintered abrasive is a seeded sol gel abrasive.

3. The bonded abrasive product of claim 2 wherein said alumina based abrasive has a density of at least 95% of theoretical density, and includes from 1% to 50% by weight of a material selected from the group consisting of zirconia, titania, magnesia, ceria, spinel, hafnia, mullite, manganese dioxide, precursors of these oxides, and mixtures thereof.

4. The bonded abrasive product of claim 2 wherein said alumina based abrasive has an aspect ratio of from 1.5 to 25, a diameter of from 0.001 mm to 2 mm, and said alpha alumina crystals have a size of less than about 1 micron.

5. The bonded abrasive product of claim 4 wherein said alpha alumina crystals have a size of less than about 0.4 micron.

6. A bonded abrasive product comprising a sintered sol-gel filament shaped alumina abrasive particle and a bond therefor, wherein the particle has a hardness of at least 18 GPa, a substantially uniform cross-section and a largest cross-section dimension of not more than 2 mm, an aspect ratio of at least 1:1 and is comprised at least 95% by weight of alpha alumina crystallites having a size of 1 micron or less.

7. A bonded abrasive product according to claim 6 in which the crystallite particle size is about 0.4 micron or less.

8. A bonded abrasive product according to claim 6 in which the particles have a largest cross-sectional dimension of 1 mm or less.

9. A bonded abrasive product according to claim 6 in which the particles have a generally circular cross-section.

10. A bonded abrasive product according to claim 6 in which the particles are essentially free from glassy components and have a breaking strength of at least 8,000 kg/cm$^2$.

11. A bonded abrasive product comprising a sintered sol-gel filament shaped alumina particle and a bond therefor, wherein the particle has a hardness of at least 18 GPa, a substantially uniform cross-section and a largest cross-sectional dimension of not more than 0.5 mm, an aspect ratio of from 2 to 8 and is at least 95% by weight comprised of alpha alumina crystallites having a size of 0.4 micron or less, is essentially free of glassy components and has a breaking strength of at least 10,000 kg/cm$^2$.

12. The bonded abrasive product of claim 1 wherein said filament shaped alumina based abrasive is curved in its longer dimension.

13. The bonded abrasive product of claim 1 wherein said filament shaped alumina based abrasive is twisted in its longer dimension.

14. The bonded abrasive product of claim 4 wherein said filament shaped alumina based abrasive is curved in its longer dimension.

15. The bonded abrasive product of claim 6 wherein said filament shaped alumina based abrasive is curved in its longer dimension.

16. The bonded abrasive product of claim 11 wherein said filament shaped alumina based abrasive is curved in its longer dimension.

17. The bonded abrasive product of claim 4 wherein said filament shaped alumina based abrasive is twisted in its longer dimension.

18. The bonded abrasive product of claim 6 wherein said filament shaped alumina based abrasive is twisted in its longer dimension.

19. The bonded abrasive product of claim 1, wherein said bonded abrasive product consists of 3% to 39% by volume of bond, 30% to 56% by volume of abrasive, and 5% to 67% by volume of pores, and wherein said bond is a vitrified bond.

20. The bonded abrasive product of claim 6, wherein said bonded abrasive product consists of 3% to 39% by volume of bond, 30% to 56% by volume of abrasive, and 5% to 67% by volume of pores, and wherein said bond is a vitrified bond.

21. The bonded abrasive product of claim 11, wherein said bonded abrasive product consists of 3% to 39% by volume of bond, 30% to 56% by volume of abrasive, and 5% to 67% by volume of pores, and wherein said bond is a vitrified bond.

22. The bonded abrasive product of claim 1, wherein said bonded abrasive product consists of 5% to 76% by volume of bond, 24% to 62% by volume of abrasive, and 0% to 71% by volume of pores, and wherein said bond is a resinoid bond.

23. The bonded abrasive product of claim 6, wherein said bonded abrasive product consists of 5% to 76% by volume of bond, 24% to 62% by volume of abrasive, and 0% to 71% by volume of pores, and wherein said bond is a resinoid bond.

24. The bonded abrasive product of claim 11, wherein said bonded abrasive product consists of 5% to 76% by volume of bond, 24% to 62% by volume of abrasive, and 0% to 71% by volume of pores, and wherein said bond is a resinoid bond.

25. The bonded abrasive product of claim 19 wherein said abrasive product includes, in addition to said sintered filament shaped alumina based abrasive, 1% to 90% by volume of a second abrasive selected from the group consisting of fused alumina, cofused alumina-zirconia, non-fiber shaped sintered alumina, non-fiber shaped sintered alumina-zirconia, silicon carbide, cubic boron nitride, diamond, flint, garnet, bubble alumina, bubble alumina-zirconia, and mixtures thereof.

26. The bonded abrasive product of claim 20 wherein said abrasive product includes, in addition to said sintered filament shaped alumina based abrasive, 1% to 90% by volume of a second abrasive selected from the group consisting of fused alumina, cofused alumina-zirconia, non-fiber shaped sintered alumina, non-fiber shaped sintered alumina-zirconia, silicon carbide, cubic boron nitride, diamond, flint, garnet, bubble alumina, bubble alumina-zirconia, and mixtures thereof.

27. The bonded abrasive product of claim 22 wherein said abrasive product includes, in addition to said sintered filament shaped alumina based abrasive, 1% to 90% by volume of a second abrasive selected from the group consisting of fused alumina, cofused alumina-zirconia, non-fiber shaped sintered alumina, non-fiber shaped sintered alumina-zirconia, silicon carbide, cubic boron nitride, diamond, flint, garnet, bubble alumina, bubble alumina-zirconia, and mixtures thereof.

28. The bonded abrasive product of claim 22 wherein said abrasive product includes, in addition to said sintered filament shaped alumina based abrasive, 1% to 90% by volume of a second abrasive selected from the group consisting of fused alumina, cofused alumina-zirconia, non-fiber shaped sintered alumina, non-fiber shaped sintered alumina-zirconia, silicon carbide, cubic boron nitride, diamond, flint, garnet, bubble alumina, bubble alumina-zirconia, and mixtures thereof.

29. The bonded abrasive product of claim 22 wherein said resinoid bond is one selected from the group consisting of phenol-formaldehyde, epoxy, polyurethane, polyester, shellac, rubber, polyimide, polybenzimidizole, phenoxy, and mixtures thereof.

30. The bonded abrasive product of claim 23 wherein said resinoid bond is one selected from the group consisting of phenol-formaldehyde, epoxy, polyurethane, polyester, shellac, rubber, polyimide, polybenzimidizole, phenoxy, and mixtures thereof.

31. The bonded abrasive product of claim 24 wherein said resinoid bond is one selected from the group consisting of phenol-formaldehyde, epoxy, polyurethane, polyester, shellac, rubber, polyimide, polybenzimidizole, phenoxy, and mixtures thereof.

* * * * *